United States Patent [19]

Leppard et al.

[11] Patent Number: 4,517,283

[45] Date of Patent: May 14, 1985

[54] COLOR-PHOTOGRAPHIC RECORDING MATERIAL

[75] Inventors: David G. Leppard, Marly; Jean Rody, Riehen, both of Switzerland

[73] Assignee: Ciba-Geigy AG, Basel, Switzerland

[21] Appl. No.: 562,190

[22] Filed: Dec. 15, 1983

[30] Foreign Application Priority Data

Dec. 16, 1982 [CH] Switzerland ..... 7314/82

[51] Int. Cl.[3] ..... G03C 7/40; G03C 7/26

[52] U.S. Cl. ..... 430/512; 430/372; 430/505; 430/523; 430/549; 430/551; 430/552; 430/554; 430/556; 430/931; 430/961

[58] Field of Search ..... 430/372, 551, 505, 512, 430/523, 931, 961, 549, 552, 554, 556

[56] References Cited

U.S. PATENT DOCUMENTS

| | | | |
|---|---|---|---|
| 3,859,293 | 1/1975 | Murayama et al. | 524/102 |
| 3,941,744 | 3/1976 | Murayama et al. | 524/102 |
| 4,110,334 | 8/1978 | Mayer et al. | 524/585 |
| 4,161,592 | 7/1979 | Evans et al. | 544/198 |
| 4,185,007 | 1/1980 | Rasberger et al. | 544/301 |
| 4,226,999 | 10/1980 | Malherbe et al. | 524/102 |
| 4,268,593 | 5/1981 | Leppard et al. | 430/372 |
| 4,452,884 | 6/1984 | Leppard . | |

*Primary Examiner*—J. Travis Brown

*Attorney, Agent, or Firm*—Wenderoth, Lind & Ponack

[57] ABSTRACT

A color-photographic recording material which, in at least one light-sensitive silver halide emulsion layer, an interlayer and/or a protective layer, contains a stabilizer mixture comprising (i) a compound with at least one group of the formula (I)

or a polymer with recurring structural units of the formula I, and (ii) a phenolic antioxidant.

Color images obtained by imagewise exposure and development of this color-photographic recording material show good stability to the action of visible and ultraviolet light.

With respect to the definitions of the substituents in formula I, reference is made to the description.

23 Claims, No Drawings

COLOR-PHOTOGRAPHIC RECORDING MATERIAL

The present application relates to a colour-photographic recording material which, in at least one light-sensitive silver halide emulsion layer and/or in at least one of the conventional auxiliary layers, contains, for stabilisation, a mixture of a polyalkylpiperidine light stabiliser, specifically substituted on the piperidine nitrogen, and a phenolic antioxidant. As sterically hindered amines, polyalkylpiperidines are generally known as light stabilizers for organic materials, in particular for polymers. In German Offenlegungsschrift No. 2,126,954, the use of such polyalkylpiperidines as an agent to counteract the fading of colour photographs was proposed in the past. Furthermore, EP-A No. 11,051 proposed the use of certain polyalkylpiperidine derivatives, which contain at least one phenol group, as light stabilisers for colour photographs. These are polyalkylpiperidine esters of hydroxybenzylmalonic acids.

It has now been found that mixtures of polyalkylpiperidine light stabilisers, specifically substituted on the piperidine nitrogen, and phenolic antioxidants exert a surprisingly improved stabilising action.

The subject of the present invention is therefore a colour-photographic recording material which, in at least one light-sensitive silver halide emulsion layer, an interlayer and/or a protective layer, contains a stabiliser mixture comprising (i) a compound which contains at least one group of the formula I

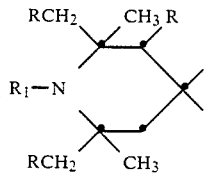

(I)

or a polymer, the recurring structural units of which contain a group of the formula I or are linked via a bivalent group corresponding to the formula I, in which $R_1$ is a free valency and in which, moreover, R is hydrogen or methyl and $R_1$ is methyl, a group $—CH_2—C(R_2)=C(R_3)(R_4)$, $—CH_2—C\equiv C—R_5$,

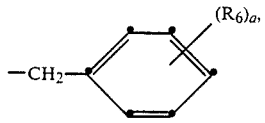

$—CH_2—COOR_7$, $—CH_2—CON(R_8)(R_9)$, $—COR_{10}$, $—COOR_7$, $—CON(R_8)(R_9)$, $—OR_7$, $-(CH_2)_b-OCOR_{10}$, $—CH_2—CH(R_{11})OR_{12}$, $—SOR_{13}$ or $—SO_2R_{13}$, a and b are one of the numbers 0, 1 or 2, $R_2$, $R_3$ and $R_4$ independently of one another are hydrogen or $C_1$–$C_3$-alkyl, $R_5$ is hydrogen or methyl, $R_6$ is $C_1$–$C_4$-alkyl, $R_7$ is $C_1$–$C_{12}$-alkyl, allyl, benzyl or cyclohexyl, $R_8$ is $C_1$–$C_{12}$-alkyl, allyl, cyclohexyl, benzyl or phenyl, $R_9$ is hydrogen, $C_1$–$C_{12}$-alkyl or allyl, or $R_8$ and $R_9$, together with the N atom to which they are linked, form a 5-membered or 6-membered heterocyclic ring, and $R_{10}$ is hydrogen, $C_4$–$C_{12}$-alkyl, $C_2$–$C_6$ alkenyl, chloromethyl, $C_5$–$C_8$-cycloalkyl, $C_7$–$C_{14}$-aralkyl or $C_7$–$C_{10}$-alkylphenyl, $R_{11}$ is hydrogen, $C_1$–$C_4$-alkyl, $C_2$–$C_{13}$-alkoxymethyl, phenyl or phenoxymethyl, $R_{12}$ is hydrogen, $C_1$–$C_{12}$-alkyl, $—COR_{10}$ or $—CON(R_8)(R_9)$, $R_8$, $R_9$ and $R_{10}$ being as defined above, and $R_{13}$ is $C_1$–$C_{12}$-alkyl, phenyl or $C_7$–$C_{14}$-alkaryl, and (ii) a phenolic antioxidant.

Those polyalkylpiperidine compounds are preferred as component (i) in which, in the group of the formula I, $R_1$ is allyl, benzyl or a group $—CH_2—COOR_7$, $—COR_{10}$, $—CON(R_8)(R_9)$, $—CH_2—CH(R_{11})OR_{12}$, $—OR_7$, or $-(CH_2)_b-OCOR_{10}$, b is one of the numbers 0, 1 or 2, $R_7$ is $C_1$–$C_4$-alkyl, allyl or benzyl, $R_8$ is $C_1$–$C_4$-alkyl, allyl or cyclohexyl, $R_9$ is $C_1$–$C_{12}$-alkyl or allyl, or $R_8$ and $R_9$, together with the N atom to which they are linked, form a morpholine or piperidine radical, and $R_{10}$ is $C_1$–$C_{12}$-alkyl, vinyl, cyclohexyl, benzyl or phenyl, $R_{11}$ is hydrogen, methyl or phenyl and $R_{12}$ is hydrogen, methyl or a group $—CON(R_8)(R_9)$, $R_8$ and $R_9$ being as already defined for these preferred compounds.

The polyalkylpiperidine compounds to be used according to the invention as component (i) include in particular the following classes of compounds (a) Compounds of the formula II

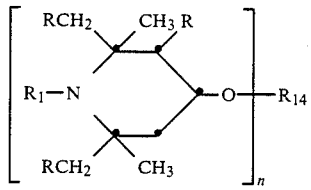

(II)

in which n is one of the numbers 1 to 4, R and $R_1$ are as defined for formula I and, with n=1, $R_{14}$ is hydrogen, $C_1$–$C_{12}$-alkyl, cyanoethyl, benzyl, glycidyl, a monovalent radical of a saturated or unsaturated aliphatic, cycloaliphatic, araliphatic or aromatic carboxylic acid, carbamic acid or phosphorus-containing acid or a monovalent silyl radical or, with n=2, $R_{14}$ is $C_2$–$C_{12}$-alkylene, $C_4$–$C_8$-alkenylene, xylylene, a divalent radical of a saturated or unsaturated aliphatic, cycloaliphatic, araliphatic or aromatic dicarboxylic acid, dicarbamic acid or phosphorus-containing acid or a divalent silyl radical or, with n=3, $R_{14}$ is a trivalent radical of an aliphatic, cycloaliphatic or aromatic tricarboxylic acid, an aromatic tricarbamic acid or a phosphorus-containing acid or a trivalent silyl radical or, with n=4, $R_{14}$ is a tetravalent radical of an aliphatic, cycloaliphatic or aromatic tetracarboxylic acid.

Any alkyl substituents are straight-chain or branched alkyl groups. $C_1$–$C_4$-alkyl groups are methyl, ethyl, n-propyl, isopropyl, n-butyl, sec.-butyl or tert.-butyl. $C_1$–$C_8$-alkyl groups additionally are, for example, n-pentyl, 2,2-dimethylpropyl, n-hexyl, 2,3-dimethylbutyl, n-octyl or 1,1,3,3-tetramethylbutyl. $C_1$–$C_{12}$-alkyl groups can additionally also be, for example, nonyl, decyl, undecyl and dodecyl. $C_1$–$C_3$-alkyl groups $R_2$, $R_3$ and $R_4$ are methyl, ethyl, n-propyl and isopropyl. Methyl is preferred.

$C_5$–$C_8$-cycloalkyl groups $R_{10}$ are, for example, cyclopentyl, cyclohexyl, cycloheptyl, α-methylcyclohexyl, cyclooctyl or dimethylcyclohexyl. Cyclohexyl is preferred.

$C_2$–$C_6$-alkenyl groups $R_{10}$ are, for example, vinyl, allyl, methallyl, dimethylallyl or 2-hexenyl. Vinyl is preferred.

$C_7$–$C_{14}$-aralkyl groups $R_{10}$ are, for example, benzyl, phenylethyl, phenylpropyl, phenylbutyl or naphthylmethyl. Benzyl is preferred.

$C_7$–$C_{10}$-alkylphenyl groups $R_{10}$ are, for example, tolyl, xylyl, isopropylphenyl, tert.-butylphenyl or diethylphenyl.

$C_2$–$C_{13}$-alkoxymethyl groups $R_{11}$ are, for example, methoxy-, ethoxy-, propoxy-, isopropoxy-, butoxy-, pentyloxy-, hexyloxy-, octyloxy-, decyloxy- or dodecyloxy-methyl.

$C_7$–$C_{14}$-alkaryl groups $R_{13}$ are, for example, phenyl substituted by $C_1$–$C_4$-alkyl, such as p-tolyl, 2,4-dimethylphenyl, 2,6-dimethylphenyl, 2,4-diethylphenyl, 2,6-diethylphenyl, 4-tert.-butylphenyl, 2,4-di-tert.-butylphenyl or 2,6-di-tert.-butylphenyl. 2,4-di-tert.-butylphenyl, 2,4-dimethylphenyl and p-tolyl are preferred.

$C_2$–$C_{12}$-alkylene groups $R_{14}$ can, for example, be ethylene, propylene, 2,2-dimethylpropylene, tetramethylene, hexamethylene, octamethylene, decamethylene or dodecamethylene.

An example of the $C_4$–$C_8$-alkenylene group $R_{14}$ is but-2-en-1,4-ylene.

A monovalent radical $R_{14}$ of a carboxylic acid is, for example, a radical of acetic acid, stearic acid, salicyclic acid, methacrylic acid, benzoic acid or $\beta$-(3,5-di-tert.-butyl-4-hydroxyphenyl)-propionic acid.

A divalent radical $R_{14}$ of a dicarboxylic acid is, for example, a radical of maleic acid, adipic acid, suberic acid, sebacic acid, phthalic acid, dibutylmalonic acid, dibenzylmalonic acid or butyl-(3,5-di-tert.-butyl-4-hydroxybenzyl)-malonic acid.

A trivalent radical $R_{14}$ of a tricarboxylic acid is, for example, a pyromellitic acid radical.

A divalent radical $R_{14}$ of a dicarbamic acid is, for example, a hexamethylene-dicarbamic acid radical or a 2,4-tolylene-dicarbamic acid radical.

Of particular interest are those compounds of the formula II in which n is one of the numbers 1 or 2 and $R_{14}$, with n=1, is a radical of an aliphatic carboxylic acid having 2–18 C atoms, a cycloaliphatic carboxylic acid having 5–12 C atoms or an aromatic carboxylic acid having 7–15 C atoms or, with n=2, is a radical of an aliphatic dicarboxylic acid having 2–12 C atoms, a cycloaliphatic or aromatic dicarboxylic acid having 8–14 C atoms or of an aliphatic, cycloaliphatic or aromatic dicarbamic acid having 8–14 C atoms.

Examples of polyalkylpiperidine compounds from this class are listed in Table I which follows.

TABLE I

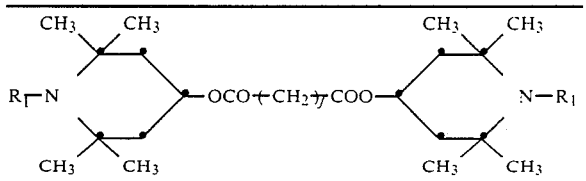

| Component (i) No. | f | $R_1$ |
|---|---|---|
| 1 | 7 | $-CH_2-$ 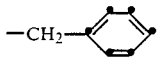 |
| 2 | 8 | $-CO-CH=CH_2$ |
| 3 | 8 | $-CH_3$ |
| 4 | 8 | $-COCH_3$ |

Further examples of compounds from this class, namely of compounds of the formula II with n=4 are the following compounds 5 and 6

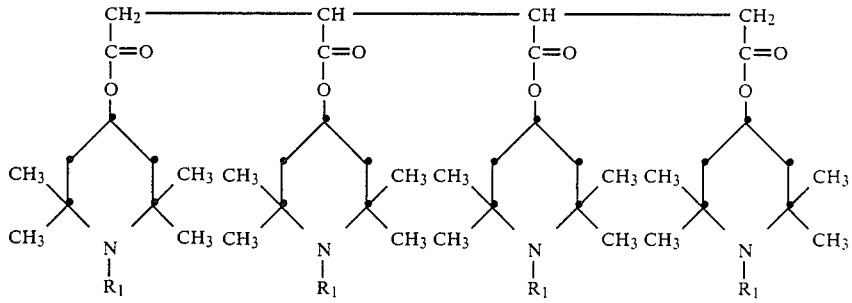

(5) $R_1 = -COCH_3$
(6) $R_1 = -CH_3$ (b) Compounds of formula III

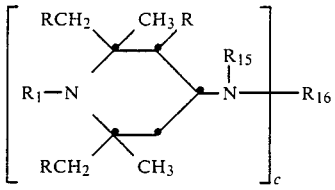

(III)

in which c is the number 1 or 2, R and $R_1$ are as defined for formula I, $R_{15}$ is $C_1$–$C_{12}$-alkyl, $C_5$–$C_8$-cycloalkyl, $C_7$–$C_8$-aralkyl, $C_2$–$C_{18}$-alkanoyl or benzoyl and, with c=1, $R_{16}$ is $C_1$–$C_{12}$-alkyl, $C_5$–$C_8$-cycloalkyl, $C_2$–$C_8$-alkenyl which is unsubstituted or substituted by a cyano group, carbonyl group or carbamide group, glycidyl, a group of the formulae $-CH_2-CH(OH)-Z$, $-COO-Z$ or $-CONH-Z$, in which Z is hydrogen, methyl or phenyl, and, with c=2, $R_{16}$ is $C_2$–$C_{12}$-alkylene, $C_6$–$C_{12}$-arylene, xylylene, a group $-CH_2-CH(OH)-CH_2-$ or a group $-CH_2-CH(OH)-CH_2-O-X-O-CH_2-CH(OH)-CH_2-$, in which X is $C_2$–$C_{10}$-alkylene, $C_6$–$C_{15}$-arylene or $C_6$–$C_{12}$-cycloalkylene, or, provided that $R_{15}$ is not alkanoyl, alkenoyl or benzoyl, $R_{16}$ can also be a divalent radical of an aliphatic, cycloaliphatic or aromatic dicarboxylic acid or dicarbamic acid, or, with c=1, $R_{15}$ and $R_{16}$ together can be the cyclic radical of an aliphatic or an aromatic 1,2- or 1,3-dicarboxylic acid.

Any $C_1$–$C_{12}$-alkyl, $C_5$–$C_8$-cycloalkyl or $C_2$–$C_{12}$-alkylene substituents are as already defined under (a).

$C_7$–$C_8$-aralkyl groups $R_{15}$ are, in particular, phenylethyl or especially benzyl.

$C_2$–$C_{18}$-alkanoyl groups $R_{15}$ are, for example, propionyl, butyryl, octanoyl, dodecanoyl, hexadecanoyl, octadecanoyl or preferably acetyl, and $C_3$–$C_5$-alkenoyl is especially acryloyl.

$C_2$–$C_8$-alkenyl groups $R_{16}$, unsubstituted or substituted by a cyano, carbonyl or carbamide group, are for example, 1-propenyl, allyl, methallyl, but-2-enyl, pent-2-enyl, hex-2-enyl, oct-2-enyl, 2,2-dicyanovinyl, 1-methyl-2-cyano-2-methoxycarbonyl-vinyl or 2,2-diacetylaminovinyl.

Any $C_6$–$C_{15}$-arylene substituents are, for example, o-, m- or p-phenylene, 1,4-naphthylene or 4,4'-diphenylene.

$C_6$–$C_{12}$-cycloalkylene groups X are in particular cyclohexylene.

Examples of polyalkylpiperidine compounds from this class are listed in Table II which follows.

TABLE II

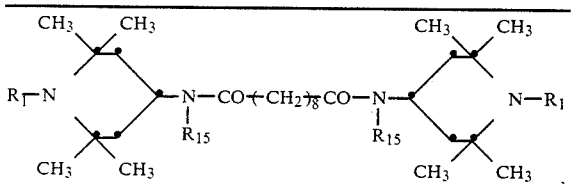

| Component (i) No. | $R_1$ | $R_{15}$ |
|---|---|---|
| 7 | —CO—CH=$CH_2$ | —$C_4H_9$ |
| 8 | —CO—CH=$CH_2$ | —H |
| 9 | —$CH_2$— 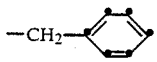 | —$C_4H_9$ |
| 10 | —$CH_2$— 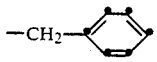 | —H |

(c) Compounds of the formula IV

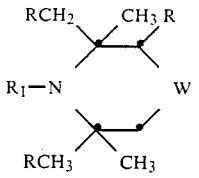

(IV)

in which R and $R_1$ are as defined for formula I and W is one of the groups

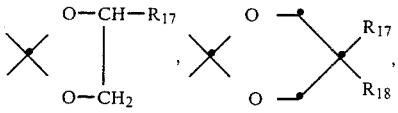

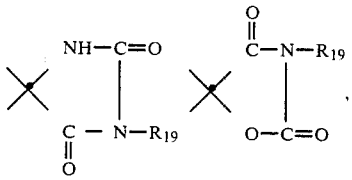

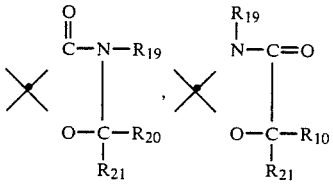

in which $R_{17}$ is hydrogen, $C_1$–$C_{12}$-alkyl, a group —$CH_2$—$OCOR_{22}$, wherein $R_{22}$ is hydrogen, $C_1$–$C_4$-alkyl, $C_2$–$C_6$-alkenyl, cyclohexyl, phenyl, benzyl or chloromethyl, a group —$CH_2O$—$S(O)_qR_{23}$, wherein $R_{23}$ is $C_1$–$C_4$-alkyl, p-tolyl or phenyl and q is the number 1 or 2, or $R_{17}$ is a group —$CH_2OCO$—$NHR_{24}$ wherein $R_{24}$ is hydrogen or $C_1$–$C_4$-alkyl, $R_{18}$ is hydrogen or $C_1$–$C_4$-alkyl, $R_{19}$ is hydrogen, $C_1$–$C_{12}$-alkyl, $C_3$–$C_4$-alkoxyalkyl, $C_5$–$C_8$-cycloalkyl, allyl or benzyl, $R_{20}$ is hydrogen, $C_1$–$C_{12}$-alkyl, $C_5$–$C_8$-cycloalkyl or benzyl, $R_{21}$ is $C_1$–$C_{12}$-alkyl, $C_5$–$C_8$-cycloalkyl or phenyl or $R_{20}$ and $R_{21}$, together with the C atom to which they are linked, form a $C_5$–$C_{12}$-cycloalkane or alkylcycloalkane ring, and W can additionally also be one of the groups of the formulae

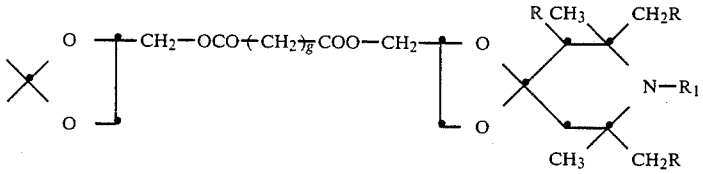

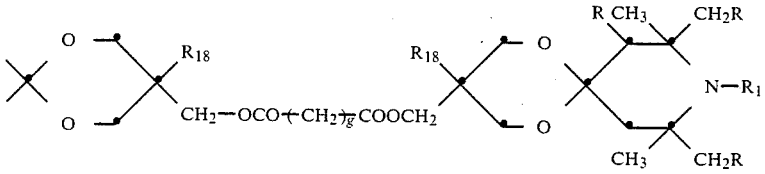

or

-continued

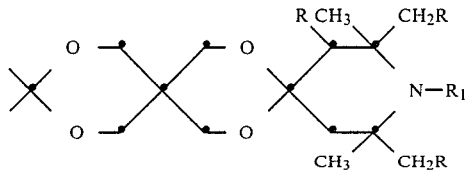

in which g is one of the numbers 1 to 12.

In the case of any $C_1$–$C_4$- or $C_1$–$C_{12}$-alkyl or $C_5$–$C_8$-cycloalkyl substituents, these are as already defined under (a).

Examples of $C_3$–$C_4$ alkoxyalkyl groups $R_{19}$ are ethoxymethyl, 2-methoxyethyl or 2-ethoxyethyl.

Examples of $C_2$–$C_6$-alkenyl groups $R_{22}$ are vinyl, allyl, methallyl, dimethylallyl or 2-hexenyl.

Examples of polyalkylpiperidine compounds from this class are listed in Table III which follows:

Further typical representatives from this class of compounds are the compounds 16 and 17:

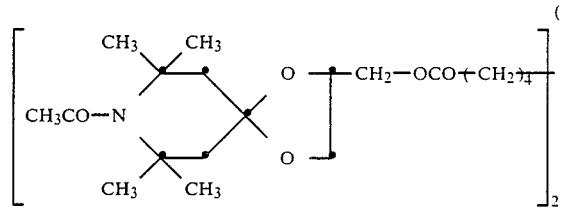

(16)

TABLE III

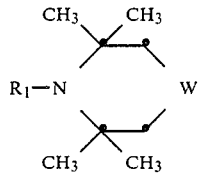

| Component (i) No. | $R_1$ | W |
|---|---|---|
| 11 | $-COCH_3$ | 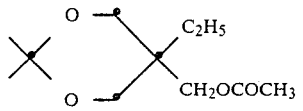 |
| 12 | $-COCH_3$ | 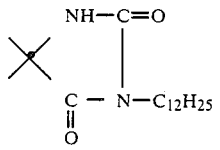 |
| 13 | $-CH_2CH_2-OH$ | 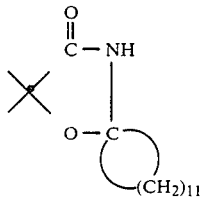 |
| 14 | $-COCH_3$ | 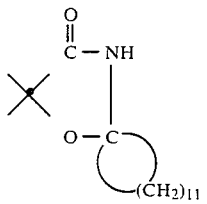 |
| 15 | $+CH_2)_2-OCO-C_{12}H_{25}$ | 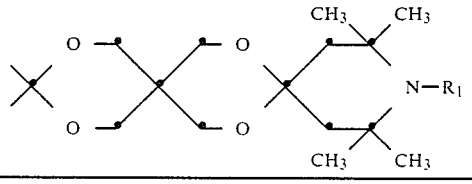 |

-continued (17)

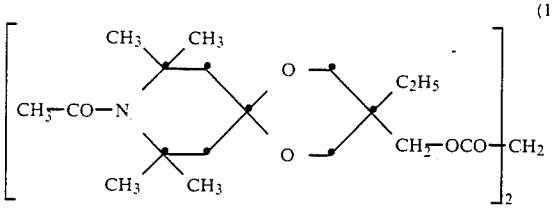

(d) Compounds of the formula V (V)

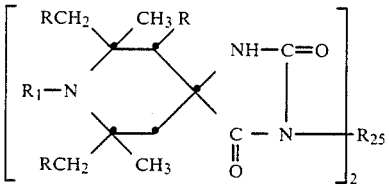

in which R and $R_1$ are as defined for formula I and $R_{25}$ is a group $C_rH_{2r}$, in which r is a number from 2 to 12, or $C_4$–$C_8$-alkenylene, $C_4$–$C_8$-alkynylene, phenylene, xylylene, bitolylene, $C_5$–$C_{12}$-cycloalkylene or a group —$CH_2$—CH(OY)$CH_2$—($OCH_2$—CH(OY)$CH_2)_2$—, wherein Y is hydrogen $C_1$–$C_{18}$-alkyl, allyl, benzyl, $C_2$–$C_{12}$-alkanoyl or benzoyl, or $R_{25}$ is a group —CONH—B—NHCO—, wherein B is a group $C_rH_{2r}$, phenylene, naphthylene, tolylene or a group of the formulae

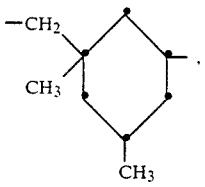

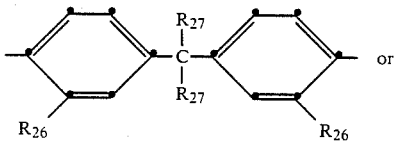

or

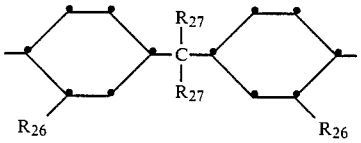

in which $R_{26}$ is hydrogen or methyl and $R_{27}$ is hydrogen, methyl or ethyl.

An example of a $C_4$–$C_8$-alkenylene group $R_{25}$ is but-2-en-1,4-ylene.

An example of a $C_4$–$C_8$-alkynylene group $R_{25}$ is but-2-yn-1,4-ylene.

$C_5$–$C_{12}$-cycloalkylene groups $R_{25}$ are, for example cyclopentylene, cyclohexylene, cyclooctylene, cyclodecylene or cyclododecylene. Cyclohexylene is preferred.

$C_1$–$C_{18}$-alkyl Y is, for example, methyl, ethyl, propyl, isopropyl, n-butyl, sec.-butyl, tert.-butyl, n-pentyl, 2,2-dimethylpropyl, n-hexyl, 2,3-dimethylbutyl, n-octyl, 1,1,3,3-tetramethylbutyl, nonyl, decyl, dodecyl, hexadecyl or octadecyl.

A $C_2$–$C_{12}$-alkanoyl group Y is, for example, propionyl, butyryl, octanoyl, dodecanoyl or, preferably, acetyl.

Examples of polyalkylpiperidine compounds from this class are the following compounds 18 and 19

(18)

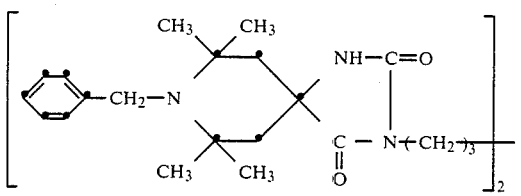

(19)

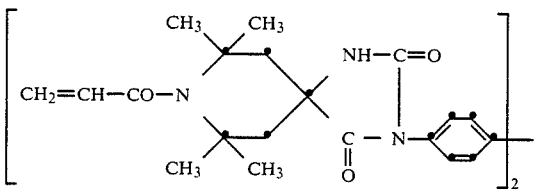

(e) Compounds of the formula VI (VI)

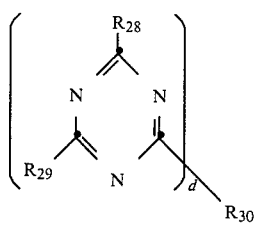

in which d is the number 1 or 2 and $R_{28}$ is a group of the formula

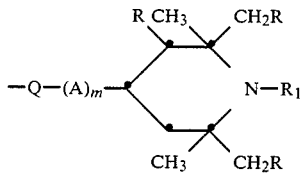

in which R and $R_1$ are as defined for formula I, Q is —O— or —N($R_{31}$)—, A is $C_2$–$C_6$-alkylene and m is the number 0 or 1, $R_{29}$ is one of the groups $R_{28}$, —$NR_{31}R_{32}$, —$OR_{33}$ —$NHCH_2OR_{33}$ or —$N(CH_2OR_{33})_2$, $R_{30}$ is, with d=1, one of the groups $R_{28}$ or $R_{29}$ and, with d=2, is the group —Q—D—Q—, in which D is $C_2$–$C_6$-alkylene which is uninterrupted or is interrupted by —N($R_{34}$)—, $R_{31}$ is hydrogen, $C_1$–$C_{12}$-alkyl, allyl, cyclohexyl, benzyl or $C_1$–$C_4$-hydroxyalkyl or a group of the formula

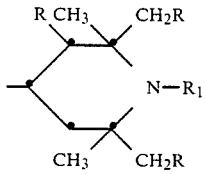

$R_{32}$ is $C_1$–$C_{12}$-alkyl, allyl, cyclohexyl, benzyl or $C_1$–$C_4$-hydroxyalkyl, $R_{33}$ is $C_1$–$C_{12}$-alkyl or phenyl and $R_{34}$ is hydrogen or a group $—CH_2OR_{33}$, or $R_{31}$ and $R_{32}$ together are $C_4$–$C_5$-alkylene or oxaalkylene, or $R_{31}$ and $R_{32}$ can also each be a group of the formula

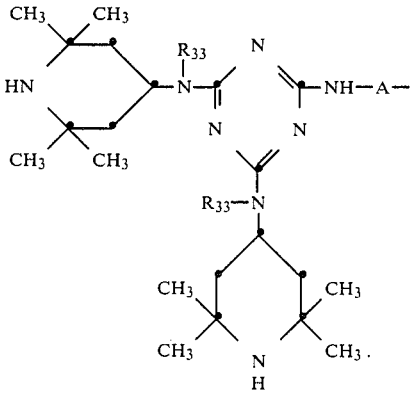

Any substituents $C_1$–$C_{12}$-alkyl are as already defined under (a).

$C_1$–$C_4$-hydroxyalkyl groups $R_{31}$ and $R_{32}$ are, for example, 2-hydroxyethyl, 2-hydroxypropyl, 3-hydroxypropyl, 2-hydroxybutyl or 4-hydroxybutyl.

$C_2$–$C_6$-alkylene groups A or D are, for example, ethylene, propylene, 2,2-dimethylpropylene, tetramethylene or hexamethylene.

If $R_{31}$ and $R_{32}$ together are $C_4$–$C_5$-alkylene or oxaalkylene, they are, for example, tetramethylene, pentamethylene or 3-oxa-pentamethylene.

Examples of polyalkylpiperidine compounds from this class are listed in Table IV which follows:

TABLE IV

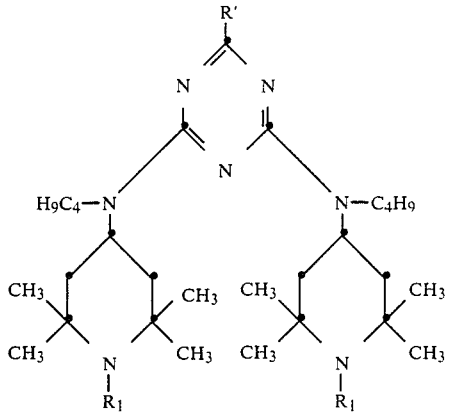

| Component (i) No. | $R_1$ | R' |
|---|---|---|
| 20 | $—CH_2—CH=CH_2$ | $—N(CH_2—CH=CH_2)_2$ |
| 21 | $—CO—CH_3$ | 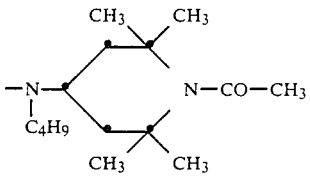 |
| 22 | $—CH_2CH_2—OH$ | 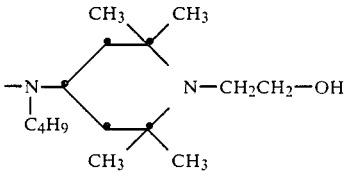 |

A further example of compounds from this class is the following compound 23

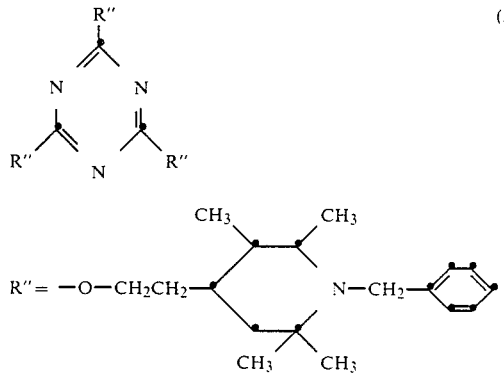

(23)

(f) Compounds of the formula VII (VII)

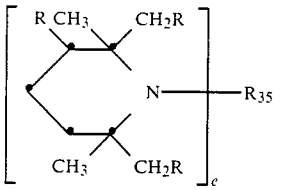

in which e is the number 1 or 2, R is hydrogen or methyl and $R_{35}$ is, with e=1, $C_4$–$C_{18}$-alkyl, $C_7$–$C_{12}$-aralkyl a group —CO—$R_{36}$ or $C_1$–$C_4$-alkyl substituted by —CN, —$COOR_{37}$, —OH, —$OCOR_{38}$ or

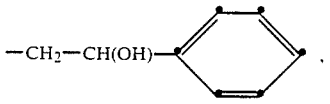

in which $R_{36}$ is $C_1$–$C_{12}$-alkyl, $C_2$–$C_4$-alkenyl or phenyl, $R_{37}$ is $C_1$–$C_{18}$-alkyl, $R_{38}$ is $C_1$–$C_{18}$-alkyl, $C_2$–$C_{10}$-alkenyl, cyclohexyl, benzyl or $C_6$–$C_{10}$-aryl, or, with e=2, $R_{35}$ is $C_4$–$C_{12}$-alkylene, but-2-en-1,4-ylene, xylylene, one of the groups —$(CH_2)_2$—OOC—$R_{39}$—COO—$(CH_2)_2$—, —$CH_2$—OOC—$R_{40}$—COO—$CH_2$— or —$CH_2$—CH(OH)—$CH_2$—O—$R_{39}$—O—$CH_2$—CH(OH)—$CH_2$—, $R_{39}$ being $C_2$–$C_{10}$-alkylene, phenylene, cyclohexylene or 2,2-diphenylenepropane and $R_{40}$ being $C_2$–$C_{10}$-alkylene, xylylene or cyclohexylene.

Any $C_1$–$C_{12}$-alkyl substituents are, for example, methyl, ethyl, n-propyl, n-butyl, sec.-butyl, tert.-butyl, n-hexyl, n-octyl, 2-ethyl-hexyl, n-nonyl, n-decyl, n-undecyl or n-dodecyl.

Any $C_1$–$C_{18}$-alkyl substituents can, for example, be the groups listed above and additionally also, for example, n-tridecyl, n-tetradecyl, n-hexadecyl or n-octadecyl.

Any $C_2$–$C_{10}$-alkylene groups are, for example, ethylene, propylene, 2,2-dimethylpropylene, tetramethylene, hexamethylene, octamethylene or decamethylene.

$C_4$–$C_{18}$-alkyl $R_{35}$ is, for example, n-butyl, sec.-butyl, tert.-butyl, n-hexyl, n-octyl, 2-ethyl-hexyl, n-nonyl, n-decyl, n-dodecyl, n-tridecyl, n-tetradecyl, n-hexadecyl or n-octadecyl.

$C_1$–$C_4$-alkyl $R_{35}$ which is substituted by —CN is, for example, cyanomethyl, cyanoethyl, 3-cyano-n-propyl or 4-cyano-n-butyl.

$C_4$–$C_{12}$-alkylene $R_{35}$ is, for example, 2,2-dimethylpropylene, tetramethylene, hexamethylene, octamethylene, decamethylene or dodecamethylene.

$C_7$–$C_{12}$-aralkyl $R_{35}$ is in particular phenylethyl, p-methyl-benzyl or especially benzyl.

$C_2$–$C_4$-alkenyl $R_{36}$ is, for example, vinyl, 1-propenyl, allyl, methallyl or 2-butenyl.

$C_2$–$C_{10}$-alkenyl $R_{38}$ is, for example, as defined for alkenyl groups $R_{36}$ and additionally also, for example, crotyl, 2-hexenyl, 2-octenyl or 2-decenyl.

$C_6$–$C_{10}$-aryl $R_{38}$ is, for example, phenyl which is unsubstituted or is substituted in the o-position or p-position by methyl, ethyl, isopropyl, n-butyl or tert.-butyl.

Examples of polyalkylpiperidine compounds from this class are the following compounds:

(24) Bis-2-(2,2,6,6-tetramethylpiperidino)-ethyl sebacate

(25) 1Octoxycarbonyl-methyl-2,2,6,6-tetramethylpiperidine

(26) 1,4-bis-(2,2,6,6-tetramethylpiperidino)-2-butene.

(g) Polymeric compounds selected from the group comprising polyesters, polyethers, polyamides, polyamines, polyurethanes, polyureas, polyaminotriazines, poly(meth)acrylates, poly(meth)acrylamides and copolymers thereof, the recurring structural units of which contain a group of the formula I or are linked via a bivalent group of the formula (I) in which $R_1$ is a free valency, R and $R_1$ in other respects being as defined for formula I.

Examples of polyalkylpiperidine compounds from this class are the compounds of the following formulae, m being a number from 2 up to about 200.

(27)

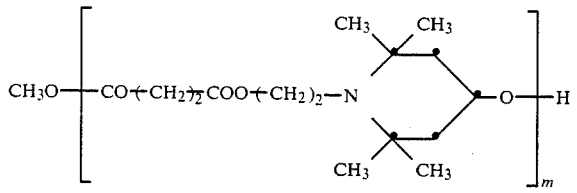

(28)

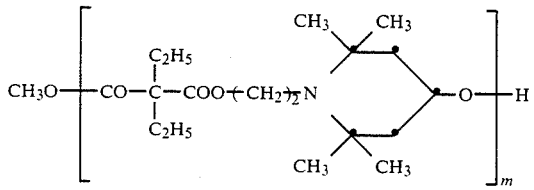

(29)

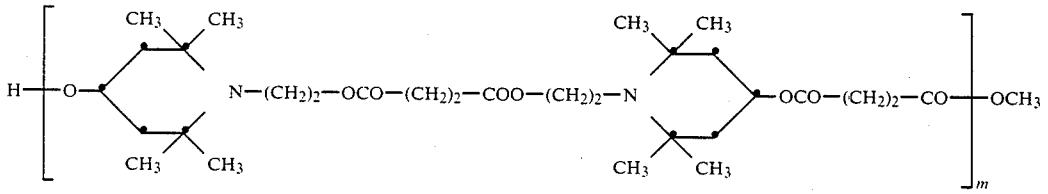

(h) Compounds of the formula VIII

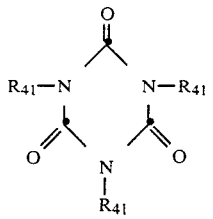

(VIII)

in which $R_{41}$ is a radical of the formula IX

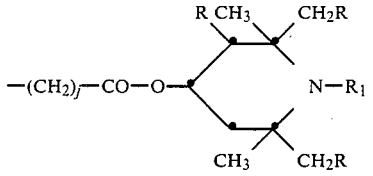

(IX)

in which j is 1 or 2 and the radicals $R_1$ and R are as defined for formula I. Examples of the polyalkylpiperidine compounds of the formula VIII are listed in Table V which follows.

TABLE V

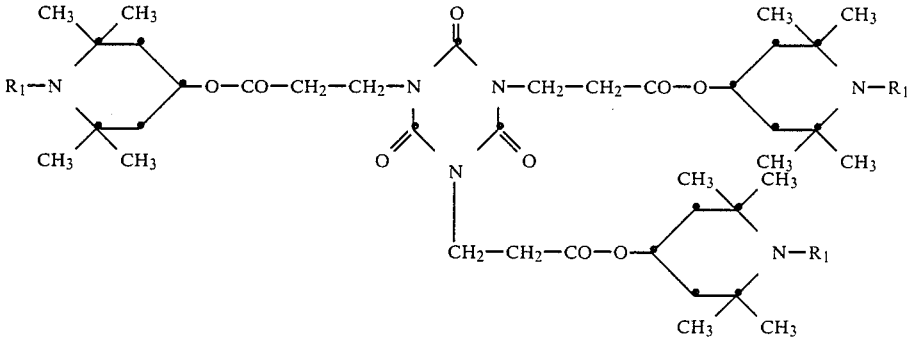

| Component (i) No. | $R_1$ |
|---|---|
| 30 | $-CO-CH_3$ |
| 31 | 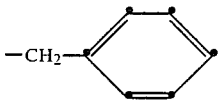 |

The polyalkylpiperidine compounds to be used, according to the invention, as the component (i) are generally known.

The phenolic antioxidants suitable as component (ii) are generally known. Particular examples are as follows:

1. Alkylated monophenols: 2,6-di-tert.-butyl-4-methylphenol, 2-tert.-butyl-4,6-dimethylphenol, 2,6-di-tert.-butyl-4-ethylphenol, 2,6-di-tert.-butyl-4-n-butylphenol, 2,6-di-tert.-butyl-4-i-butylphenol, 2,6-di-cyclopentyl-4-methylphenol, 2(α-methylcyclohexyl)-4,6-dimethylphenol, 2,6-di-octadecyl-4-methylphenol, 2,4,6-tri-cyclohexylphenol and 2,6-di-tert.-butyl-4-methoxymethylphenol.

2. Alkylated hydroquinones: 2,6-di-tert.-butyl-4-methoxyphenol, 2,5-di-tert.butyl-hydroquinone, 2,5-di-tert.-amyl-hydroquinone and 2,6-diphenyl-4-octadecyloxyphenol.

3. Alkylidine-bisphenols: 2,2'-methylene-bis-(6-tert.-butyl-4-methylphenol), 2,2'-methylene-bis-(6-tert.-butyl-4-ethylphenol), 2,2'-methylene-bis-[4-methyl-6(α-methylcyclohexyl)-phenol], 2,2'-methylene-bis-(4-methyl-6-cyclohexylphenol), 2,2'-methylene-bis-(6-nonyl-4-methylphenol), 2,2'-methylene-bis-(4,6-di-tert.-butylphenol), 2,2'-ethylidene-bis-(4,6-di-tert.-butylphenol), 2,2'-ethylidene-bis-(6-tert.-butyl-4-isobutylphenol), 4,4'-methylene-bis-(2,6-di-tert.-butylphenol), 4,4'-methylene-bis-(6-tert.-butyl-2-methylphenol), 1,1-bis-(5-tert.-butyl-4-hydroxy-2-methylphenyl)-butane, 2,6-di-(3-tert.-butyl-5-methyl-2-hydroxybenzyl)-4-methylphenol, 1,1,3-tris-(5-tert.-butyl-4-hydroxy-2-methylphenyl)-butane, 1,1-bis-(5-tert.-butyl-4-hydroxy-2-methylphenyl)-3-n-dodecylmercaptobutane, ethylene glycol bis-[3,3-bis-(3'-tert.-butyl-4'-hydroxyphenyl)-butyrate], di-(3-tert.-butyl-4-hydroxy-5-methylphenyl)-dicyclopentadiene and di-[2-(3'-tert.-butyl-2'-hydroxy-5'-methyl-benzyl)-6-tert.-butyl-4-methyl-phenyl]terephthalate.

4. Benzyl compounds: 1,3,5-tri-(3,5-di-tert.-butyl-4-hydroxybenzyl)-2,4,6-trimethylbenzene, di-(3,5-di-tert.-butyl-4-hydroxybenzyl)sulfide, isooctyl 3,5-di-tert.-butyl-4-hydroxybenzyl-mercaptoacetate, bis-(4-tert.-butyl-3-hydroxy-2,6-dimethylbenzyl)-dithiol terephthalate, 1,3,5-tris-(3,5-di-tert.-butyl-4-hydroxybenzyl-)isocyanurate, 1,3,5-tris-(4,-tert.-butyl-3-hydroxy-2,6-dimethylbenzyl)isocyanurate, dioctadecyl 3,5-di-tert.-butyl-4-hydroxybenzylphosphonate and the calcium salt of monoethyl 3,5-di-tert.-butyl-4-hydroxybenzylphosphonate.

5. Acylaminophenols: lauric acid 4-hydroxy-anilide, stearic acid 4-hydroxy-anilide and 2,4-bis-octylmercapto-6-(3,5-di-tert.-butyl-4-hydroxyanilino)-s-triazine.

6. Esters of β-(3,5-di-tert.-butyl-4-hydroxyphenyl)-propionic acid with monohydric or polyhydric alcohols, for example with methanol, octadecanol, 1,6-hexanediol, neopentyl glycol, thiodiethylene glycol, diethylene glycol, triethylene glycol, pentaerythritol, tris-hydroxyethyl isocyanurate or oxalic acid di-hydroxyethyl-diamide.

7. Esters of 3,5-di-tert.-butyl-4-hydroxyphenylbenzoic acid: pentaerythritol tetrakis-(3,5-di-tert.-butyl-4-hydroxybenzoate) and 2,4-di-tert.-butylphenyl 3,5-di-tert.-butyl-4-hydroxybenzoate.

8. Esters of β-(5-tert.-butyl-4-hydroxy-3-methylphenyl)-propionic acid with monohydric or polyhydric alcohols, for example with methanol, octadecanol, 1,6-hexanediol, neopentyl glycol, thiodiethylene glycol, diethylene glycol, triethylene glycol, pentaerythritol, tris-hydroxyethyl isocyanurate or oxalic acid dihydroxyethyl-diamide.

9. Amides of 62 -(3,5-di-tert.-butyl-4-hydroxyphenyl)-propionic acid, for example N,N'-di-(3,5-di-tert.-butyl-4-hydroxyphenylpropionyl)-hexamethylenediamine, N,N'-di-(3,5-di-tert.-butyl-4-hydroxyphenylpropionyl)-trimethylenediamine and N,N'-di-(3,5-di-tert.-butyl-4-hydroxyphenylpropionyl)-hydrazine.

10. Triazine-phenols, for example the compounds of the formula X

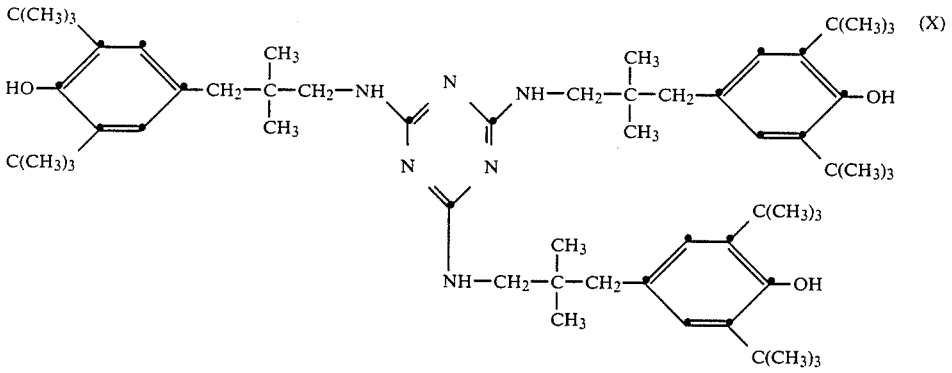

The following phenolic antioxidants are preferred as the component ii):

(1) 2,6-Di-tert.-butyl-4-methylphenol,
(2) 2,2'-Methylene-bis-(6-tert.-butyl-4-methylphenol),
(3) 2,2'-Methylene-bis-(6-tert.-butyl-4-ethylphenol),
(4) 4,4'-Methylene-bis-(2,6-di-tert.-butylphenol),
(5) 2,2-Bis-(2,6-di-tert.-butyl-4-hydroxyphenyl)-propane,
(6) 2,2'-Methylene-bis-[4-methyl-6-(α-methylcyclohexyl)-phenol],
(7) 1,1-Bis-5-tert.-butyl-4-hydroxy-2-methylphenyl)-butane,
(8) 1,1,3-Tris-(5-tert.-butyl-4-hydroxy-2-methylphenyl)-butane,
(9) Ethylene glycol bis-[3,3-bis-(3-tert.-butyl-4-hydroxyphenyl)-butyrate],
(10) 4,4'-Thio-bis-(6-tert.-butyl-3-methylphenol),
(11) 1,3,5-Tri-(3,5-di-tert.-butyl-4-hydroxybenzyl)-2,4,6-trimethylbenzene,
(12) Triethylene glycol bis-(3-methyl-5-tert.-butyl-4-hydroxyphenyl)-propionate,
(13) 1,3,5-Tris-(3,5-di-tert.-butyl-4-hydroxybenzyl-)isocyanurate,
(14) Diethyl 3,5-di-tert.-butyl-4-hydroxybenzylphosphonate,
(15) N,N'-Di-(3,5-di-tert.-butyl-4-hydroxyphenylpropionyl)-hexamethylenediamine,
(16) 3-Thia-1,5-pentanediol bis-[3-(3,5-di-tert.-butyl-4-hydroxyphenyl)-propionate],
(17) 1,6-Hexanediol bis-[3-(3,5-di-tert.-butyl-4-hydroxyphenyl)-propionate],
(18) Pentaerythritol tetrakis-[3-(3,5-di-tert.-butyl-4-hydroxyphenyl)-propionate],
(19) Pentaerythritol tetrakis-(3,5-di-tert.-butyl-4-hydroxybenzoate),
(20) Octadecyl-3-(3,5-di-tert.-butyl-4-hydroxyphenyl)-propionate,
(21) 2-(3,5-Di-tert.-butyl-4-hydroxyanilino)-4,6-di-(octylthio)-triazine,
(22) 2,4-Di-tert.-butylphenyl 3,5-di-tert.-butyl-4-hydroxybenzoate,
(23) The phenol of the formula XI

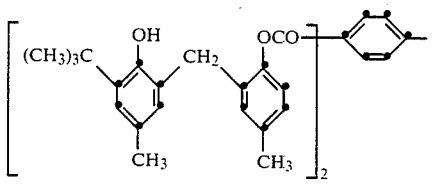

(24) the phenol of the formula X

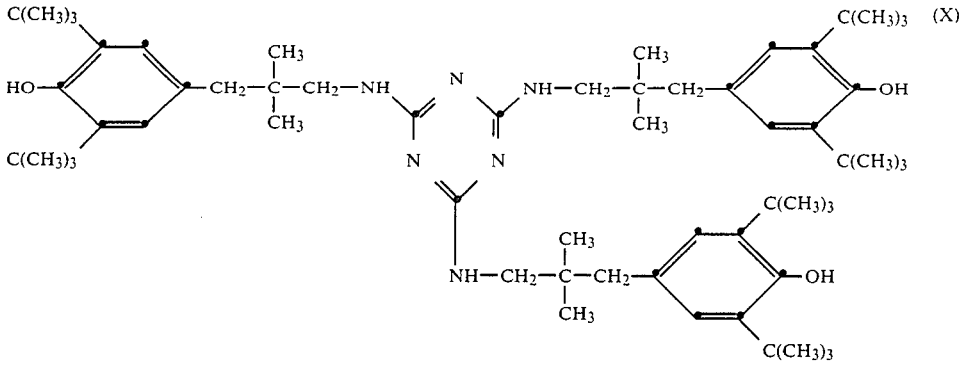

(X)

The stabiliser mixture according to the invention can be incorporated, by itself or together with other compounds, in a known manner into a photographic material.

The mixing ratio of the polyalkylpiperidine light stabiliser (i) and the phenolic antioxidant (ii) varies, for example, between 90:10 and 10:90, preferably between 70:30 and 30:70.

As a rule, the stabiliser mixture is incorporated, by itself or together with other compounds, in particular with the colour couplers, in the form of a dispersion into the photographic material, this dispersion either containing no solvent or containing high-boiling or low-boiling solvents or a mixture of such solvents. In a further suitable incorporation method, the stabilisers are incorporated, by themselves or together with other compounds, together with a polymer in the form of a latex into the photographic material.

The dispersions are then used for preparing the layers of colour-photographic recording materials. These layers can be, for example, interlayers or protective layers, but in particular light-sensitive (blue-sensitive, green-sensitive and red-sensitive) silver halide emulsion layers in which, on development of the exposed recording material, the cyan, magenta and yellow dyes are formed from the corresponding colour couplers.

The silver halide layers can contain any desired colour couplers, in particular cyan, magenta and yellow couplers, which are used for forming the said dyes and hence the colour formers.

Since the substrate has an influence on the action and stability of the stabiliser mixtures, those substrates (solvents, polymers) are preferred which, together with the stabilisers, result in the best possible stability of the materials which are to be stabilised.

As a rule, the stabiliser mixtures are incorporated into layers which additionally contain a silver halide dispersion which has been prepared and sensitised by conventional methods. However, they can also be present in layers adjacent to the layers containing silver halide.

The photographic materials according to the invention have a conventional structure and contain components which intensify the activity of the stabiliser mixtures or at least do not affect it adversely.

In a colour-photographic recording material according to the present invention, the stabiliser mixtures containing the components (i) and (ii) can, apart from the colour couplers, additionally also be combined with ultraviolet absorbers or other light stabilisers in the same layer.

If the diffusion transfer method is used, the stabiliser mixture can also be incorporated into a receiving layer.

The colour-photograhic materials according to the invention can be processed in the known manner. Moreover, during or after processing, they can be treated in a way which further increases their stability, for example by treating in a stabiliser bath or by applying a protective coating.

The invention also relates to a process for the production of photographic colour images by imagewise exposure and colour development of a colour-photograhic recording material containing a stabiliser mixture with the components (i) and (ii). Further, the invention relates to the photographic colour images obtained by this process.

The stabiliser mixtures, to be used according to the invention, are in some cases also suitable for protecting colour-photographic layers in which the dyes are incorporated directly into the emulsion and the image is produced by selective bleaching.

The quantity of stabiliser mixture can vary within wide limits and is approximately in the range from 1 to 2,000 mg, preferably 100 to 800 and in particular 200 to 500 mg, per $m^2$ of the layer into which it is being incorporated.

If the photographic material contains one or more ultraviolet absorbers, this or these can be present together with the stabiliser mixture in one layer or even in an adjacent layer. The quantity of ultraviolet absorber can vary within wide limits and is approximately in the range from 200–2,000 mg, preferably 400–1,000 mg, per $m^2$ of the layer. Examples of suitable ultraviolet absorbers are those of the benzophenone, acrylonitrile, thiazolidone, benzotriazole, oxazole, thiazole and imidazole types.

The colour images obtained by exposure and development, using the recording material according to the invention, show very good light fastness to visible and ultraviolet light. The stabiliser mixtures (i)+(ii) are virtually colourless, so that there is no discolouration of the images; furthermore, they are highly compatible with the conventional photographic additives present in the individual layers. Due to their high activity, the quantity in which they are used can be reduced, and they are thus prevented from precipitating or crystallising out, when they are incorporated as an organic solution into the aqueous binder emulsions which are used for the preparation of photographic layers. The individual processing steps, necessary for the production of colour images after the exposure of the photographic recording material, are not adversely affected by the stabiliser mixtures (i)+(ii). Moreover, the so-called abrasion fog which frequently occurs with blue-sensitive emulsions can be largely suppressed. This can occur, for example, when mechanical stresses, for example twisting, bending or rubbing, are exerted during production or during the treatment before development on photograhic materials (silver halide emulsion layers located on a base of natural or synthetic materials) (T. H. James, *The Theory of Photographic Process,* 4th edition, Macmillan, New York, N.Y. 1977, pages 23 et seq. and pages 166 et seq.).

APPLICATION EXAMPLES

1. Test substances

1.1 Phenols (a)

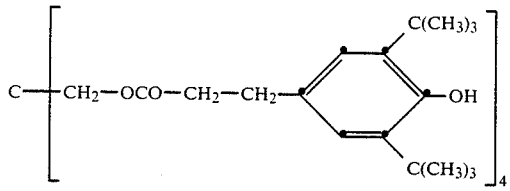

(b)

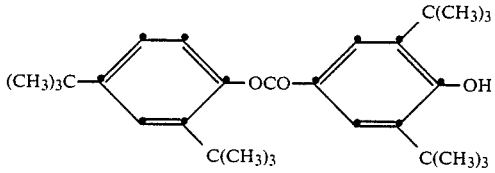

(c)

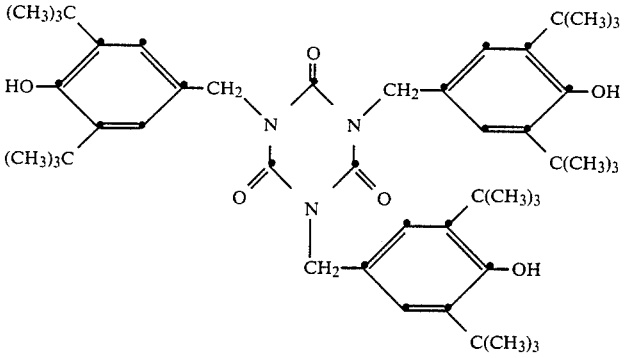

(d)

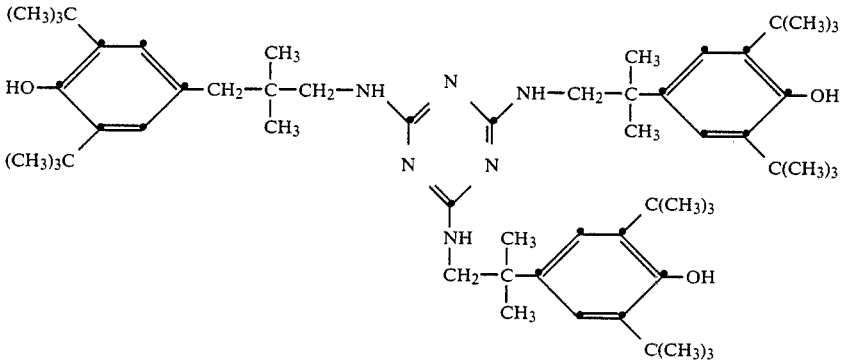

(e)

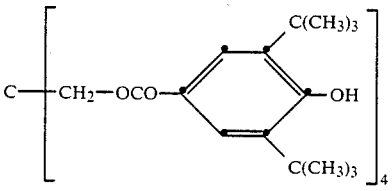

1.2 Piperidines
2. Application Example 1
(A)
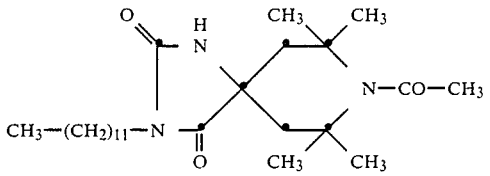
(B)
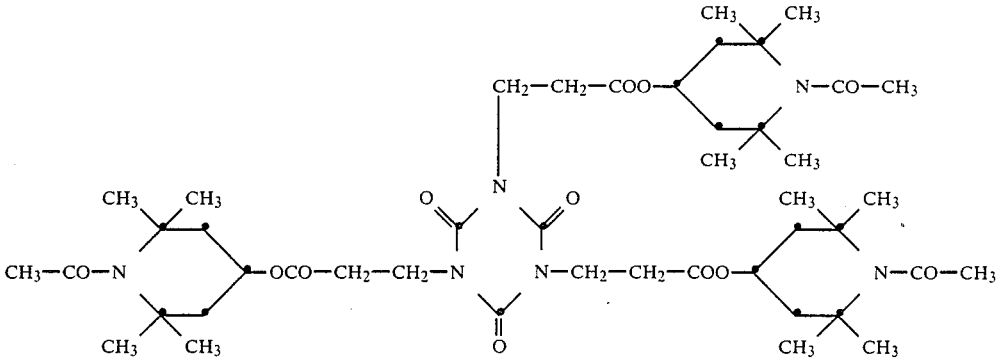
(C)
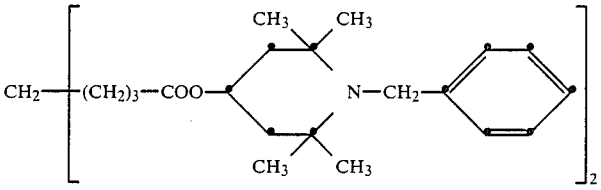
(D)
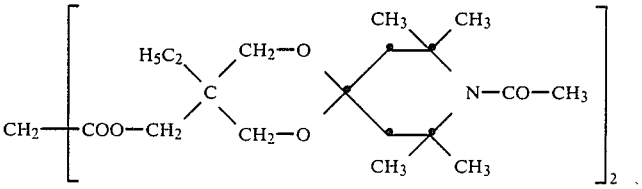
(E)
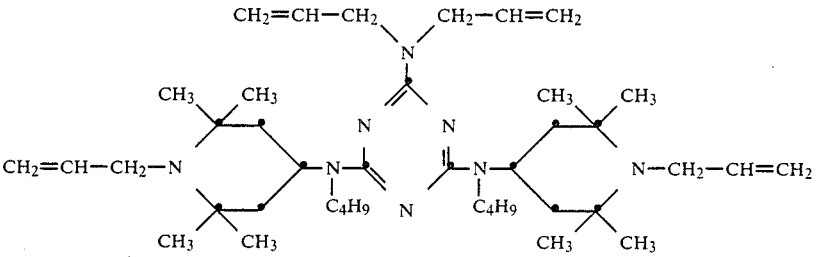
0.093 g of the yellow coupler of the formula
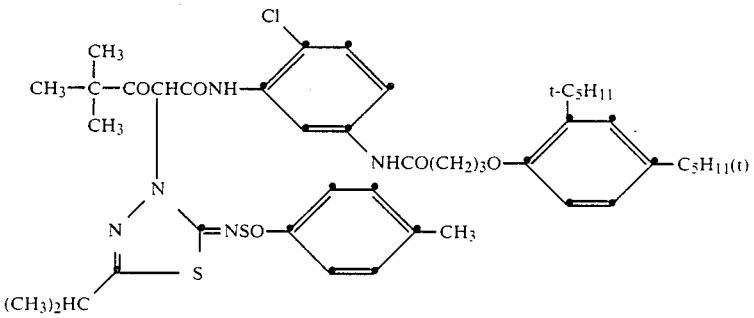

and the quantities, shown in Table 1, of a sterically hindered phenol (compounds a to c) and of a piperidine (compounds A and B) are dissolved in 2.0 ml of a tricresylphosphate/ethyl acetate mixture (1.5 g in 100 ml). 7.0 ml of a 6% gelatine solution, 0.5 ml of an 8% solution of the wetting agent of the formula

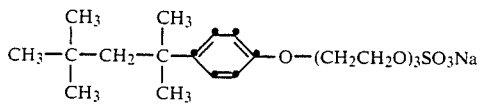

in isopropanol/water (3:4) and 0.5 ml of water are added to the above solution and the mixture is ultrasonically emulsified at a power of 100 watt for 5 minutes.

2.0 ml of a silver bromide emulsion having a silver content of 6.0 g per liter, 0.7 ml of a 1% aqueous solution of the hardener of the formula

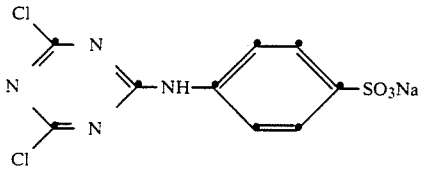

and 3.8 ml of water are added to 2.5 ml of the emulsion thus obtained, and the mixture is adjusted to a pH value of 6.5 and coated onto a subbed, plastic-coated white paper mounted on a glass plate.

After solidification, the plate with the emulsion is dried in a circulating air oven at room temperature.

After 7 days, samples cut to a size of 35×180 mm are exposed behind a step wedge with 3,000 lux×second and then processed by the Ektaprint 2® process of Messrs. Kodak.

The yellow wedges thus obtained are irradiated in an Atlas Weather-Ometer under a 2,500 W xenon lamp with a total of 42 kjoules/cm$^2$ (a comparative sample does not contain any light stabiliser).

The percentage decreases in the yellow density, with an initial reflectance density of 1.0 in the blue, are given in Table 1.

TABLE 1

| Phenol No. | Phenol Quantity (g) | Piperidine No. | Piperidine Quantity (g) | Density decrease in percent at the maximum |
|---|---|---|---|---|
| a | 0.370 | — | — | 24 |
| — | — | B | 0.370 | 22 |
| a | 0.185 | B | 0.185 | 21 |
| b | 0.278 | — | — | 22 |

TABLE 1-continued

| Phenol No. | Phenol Quantity (g) | Piperidine No. | Piperidine Quantity (g) | Density decrease in percent at the maximum |
|---|---|---|---|---|
| — | — | B | 0.278 | 23 |
| b | 0.139 | B | 0.139 | 20 |
| c | 0.186 | — | — | 27 |
| — | — | A | 0.186 | 25 |
| c | 0.093 | A | 0.093 | 23 |
| — | — | — | — | 36 |

It is clear from Table 1 that the combination of a sterically hindered phenol with a piperidine results in a light-stabilising effect which is improved over that of the individual components.

3. Application Example 2

Samples are prepared and irradiated as described in Example 1, except that the sterically hindered phenol and the piperidine are added in molar proportions relative to the yellow coupler.

Table 2 contains the resulting decreases in density.

TABLE 2

| Phenol No. | Phenol Quantity[1] | Piperidine No. | Piperidine Quantity[1] | Density decrease in percent at the maximum |
|---|---|---|---|---|
| — | — | — | — | 36 |
| a | 0.3 | C | 0.1 | 12 |
| b | 0.2 | A | 0.2 | 17 |
| c | 0.3 | C | 0.3 | 16 |
| d | 0.3 | E | 0.3 | 16 |
| e | 0.3 | D | 0.1 | 15 |

[1]Quantity in moles per mole of yellow coupler

It is clear from Table 2 that results similar to those of Application Example 1 are obtained, if molar ratios are used instead of weight ratios.

4. Application Example 3

Samples are prepared as described in Examples 1 and 2, except that, instead of the yellow coupler used therein, they contain the yellow coupler of the formula

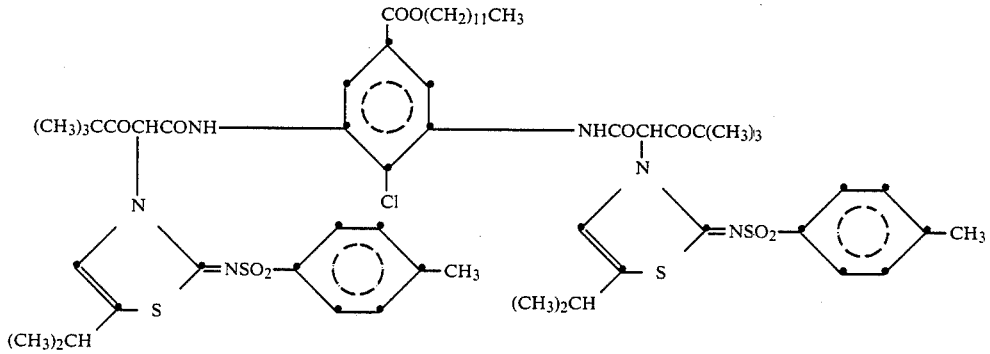

These samples are irradiated in an Atlas Weather-Ometer with a total of 105 kjoules/cm$^2$ behind a Kodak Wratten 2C filter.

Table 3 contains the percentage density decreases, thus obtained, at the maximum, with an initial reflectance density of 1.0.

TABLE 3

| Phenol | | Piperidine | | Density decrease in percent at the maximum |
|---|---|---|---|---|
| No. | Quantity[1] | No. | Quantity | |
| — | — | — | — | 23 |
| b | 0.2 | C | 0.2 | 15 |

[1]Quantity in moles per mole of yellow coupler

What is claimed:

1. A colour-photographic recording material which, in at least one light-sensitive silver halide emulsion layer, an interlayer and/or a protective layer, contains a light stabilizing amount of a stabiliser mixture comprising (i) a compound which contains at least one group of the formula I

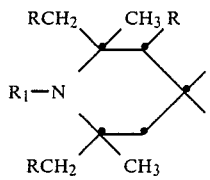

(I)

or a polymer, the recurring structural units of which contain a group of the formula I or are linked via a bivalent group corresponding to the formula I, in which $R_1$ is a free valency and in which, moreover, R is hydrogen or methyl and $R_1$ is methyl, a group $—CH_2—C(R_2)=C(R_3)(R_4)$, $—CH_2—C\equiv C—R_5$,

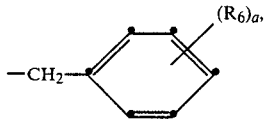

$—CH_2—COOR_7$, $—CH_2—CON(R_8)(R_9)$, $—COR_{10}$, $—COOR_7$, $—CON(R_8)(R_9)$, $—OR_7$, $-(CH_2)_b-OCOR_{10}$, $—CH_2—CH(R_{11})OR_{12}$, $—SOR_{13}$ or $—SO_2R_{13}$, a and b are 0, 1 or 2, $R_2$, $R_3$ and $R_4$ independently of one another are hydrogen or $C_1$–$C_3$-alkyl, $R_5$ is hydrogen or methyl, $R_6$ is $C_1$–$C_4$-alkyl, $R_7$ is $C_1$–$C_{12}$-alkyl, allyl, benzyl or cyclohexyl, $R_8$ is $C_1$–$C_{12}$-alkyl, allyl, cyclohexyl, benzyl or phenyl, $R_9$ is hydrogen, $C_1$–$C_{12}$-alkyl or allyl, or $R_8$ and $R_9$, together with the N atom to which they are linked, form a 5-membered or 6-membered heterocyclic ring, and $R_{10}$ is hydrogen, $C_4$–$C_{12}$-alkyl, $C_2$–$C_6$ alkenyl, chloromethyl, $C_5$–$C_8$-cycloalkyl, $C_7$–$C_{14}$-aralkyl or $C_7$–$C_{10}$-alkylphenyl, $R_{11}$ is hydrogen, $C_1$–$C_4$-alkyl, $C_2$–$C_{13}$-alkoxymethyl, phenyl or phenoxymethyl, $R_{12}$ is hydrogen, $C_1$–$C_{12}$-alkyl, $—COR_{10}$ or $—CON(R_8)(R_9)$ $R_8$, $R_9$ and $R_{10}$ being as defined above, and $R_{13}$ is $C_1$–$C_{12}$-alkyl, phenyl or $C_7$–$C_{14}$-alkaryl, and (ii) a phenolic antioxidant.

2. A colour-photographic recording material according to claim 1, wherein, in the formula I, $R_1$ is allyl, benzyl or a group $—CH_2—COOR_7$, $—COR_{10}$, $—CON(R_8)(R_9)$, $—CH_2—CH(R_{11})OR_{12}$, $—OR_7$, or $-(CH_2)_b-OCOR_{10}$.

b is 0, 1 or 2, $R_7$ is $C_1$–$C_4$-alkyl, allyl or benzyl, $R_8$ is $C_1$–$C_4$-alkyl, allyl or cyclohexyl, $R_9$ is $C_1$–$C_{12}$-alkyl or allyl, or $R_8$ and $R_9$, together with the N atom to which they are linked, form a morpholine or piperidine radical, and $R_{10}$ is $C_1$–$C_{12}$-alkyl, vinyl, cyclohexyl, benzyl or phenyl, $R_{11}$ is hydrogen, methyl or phenyl and $R_{12}$ is hydrogen, methyl or a group $—CON(R_8)(R_9)$, $R_8$ and $R_9$ being as already defined in this claim.

3. A colour-photographic recording material according to claim 1, which contains, as the component (i), a compound of the formula II

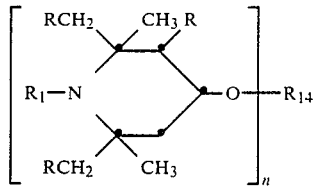

(II)

in which n is an integer of 1 to 4, R and $R_1$ are as defined for claim 1 and, with n=1, $R_{14}$ is hydrogen, $C_1$–$C_{12}$-alkyl, cyanoethyl, benzyl, glycidyl, a monovalent radical of a saturated or unsaturated aliphatic, cycloaliphatic, araliphatic or aromatic carboxylic acid, carbamic acid or phosphorus-containing acid or a monovalent silyl radical or, with n=2, $R_{14}$ is $C_2$–$C_{12}$-alkylene, $C_4$–$C_8$-alkenylene, xylylene, a divalent radical of a saturated or unsaturated aliphatic, cycloaliphatic, araliphatic or aromatic dicarboxylic acid, dicarbamic acid or phosphorus-containing acid or a divalent silyl radical or, with n=3, $R_{14}$ is a trivalent radical of an aliphatic, cycloaliphatic or aromatic tricarboxylic acid, an aromatic tricarbamic acid or a phosphorus-containing acid or a trivalent silyl radical or, with n=4, $R_{14}$ is a tetravalent radical of an aliphatic, cycloaliphatic or aromatic tetracarboxylic acid.

4. A colour-photographic recording material according to claim 3, wherein, in the compound of the formula II, n is one of the numbers 1 or 2 and $R_{14}$, with n=1, is a radical of an aliphatic carboxylic acid having 2–18 C atoms, a cycloaliphatic carboxylic acid having 5–12 C atoms or an aromatic carboxylic acid having 7–15 C atoms or, with n=2, is a radical of an aliphatic dicarboxylic acid having 2–12 C atoms, a cycloaliphatic or aromatic dicarboxylic acid having 8–14 C atoms or of an aliphatic, cycloaliphatic or aromatic dicarbamic acid having 8–14 C atoms.

5. A colour-photographic recording material according to claim 1, which contains, as the component (i), a compound of the formula III

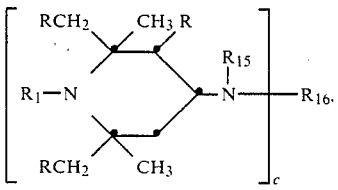

(III)

in which c is 1 or 2, R and $R_1$ are as defined in claim 1, $R_{15}$ is $C_1$–$C_{12}$-alkyl, $C_5$–$C_8$-cycloalkyl, $C_7$–$C_8$-aralkyl, $C_2$–$C_{18}$-alkanoyl or benzoyl and, with c=1, $R_{16}$ is $C_1$–$C_{12}$-alkyl, $C_5$–$C_8$-cycloalkyl, $C_2$–$C_8$-alkenyl which is unsubstituted or substituted by a cyano group, carbonyl group or carbamide group, glycidyl, a group of the formulae —$CH_2$—CH(OH)—Z, —COO—Z or —CONH—Z, in which Z is hydrogen, methyl or phenyl, and, with c=2, $R_{16}$ is $C_2$–$C_{12}$-alkylene, $C_6$–$C_{12}$-arylene, xylylene, a group —$CH_2$—CH(OH)—$CH_2$— or a group —$CH_2$—CH(OH)—$CH_2$—O—X—O—$CH_2$—CH(OH)—$CH_2$—, in which X is $C_2$–$C_{10}$-alkylene, $C_6$–$C_{15}$-arylene or $C_6$–$C_{12}$-cycloalkylene, or, provided that $R_{15}$ is not alkanoyl, alkenoyl or benzoyl, $R_{16}$ can also be a divalent radical of an aliphatic, cycloaliphatic or aromatic dicarboxylic acid or dicarbamic acid, or, with c=1, $R_{15}$ and $R_{16}$ together can be the cyclic radical of an aliphatic or an aromatic 1,2- or 1,3-dicarboxylic acid.

6. A colour-photographic recording material according to claim 1, which contains, as the component (i), a compound of the formula IV

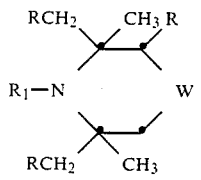

in which R and $R_1$ are as defined in claim 1 and W is one of the groups

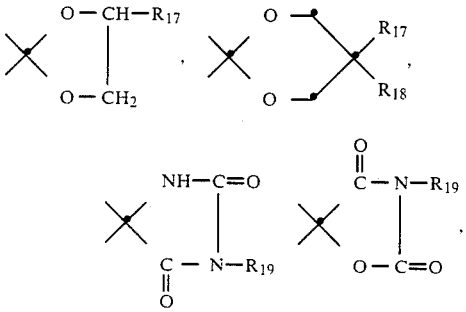

-continued

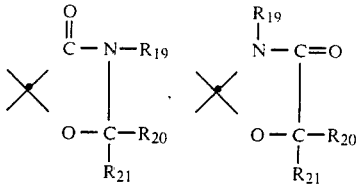

in which $R_{17}$ is hydrogen, $C_1$–$C_{12}$-alkyl, a group —$CH_2$—$OCOR_{22}$, wherein $R_{22}$ is hydrogen, $C_1$–$C_4$-alkyl, $C_2$–$C_6$-alkenyl, cyclohexyl, phenyl, benzyl or chloromethyl, a group —$CH_2O$—$S(O)_qR_{23}$, wherein $R_{23}$ is $C_1$–$C_4$-alkyl, p-tolyl or phenyl and q is 1 or 2, or $R_{17}$ is a group —$CH_2OCO$—$NHR_{24}$ wherein $R_{24}$ is hydrogen or $C_1$–$C_4$-alkyl, $R_{18}$ is hydrogen or $C_1$–$C_4$-alkyl, $R_{19}$ is hydrogen, $C_1$–$C_{12}$-alkyl, $C_3$–$C_4$-alkoxyalkyl, $C_5$–$C_8$-cycloalkyl, allyl or benzyl, $R_{20}$ is hydrogen, $C_1$–$C_{12}$-alkyl, $C_5$–$C_8$-cycloalkyl or benzyl, $R_{21}$ is $C_1$–$C_{12}$-alkyl, $C_5$–$C_8$-cycloalkyl or phenyl or $R_{20}$ and $R_{21}$, together with the C atom to which they are linked, form a $C_5$–$C_{12}$-cycloalkane or alkylcycloalkane ring, and W can additionally also be one of the groups of the formulae

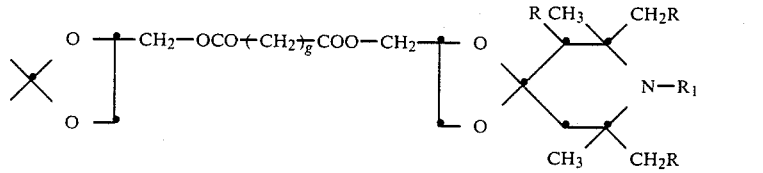

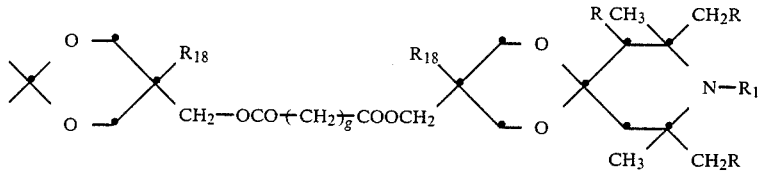

or

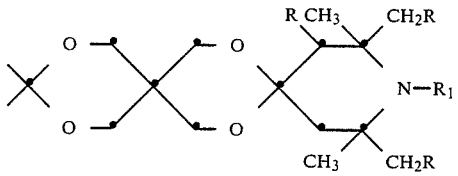

in which g is 1 to 12.

7. A colour-photographic recording material according to claim 1, which contains, as the component (i), a compound of the formula V

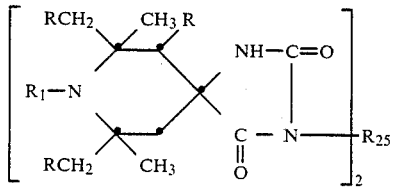

(V)

in which R and $R_1$ are as defined in claim 1 and $R_{25}$ is a group $C_rH_{2r}$, in which r is an integer of from 2 to 12, or $C_4$–$C_8$-alkenylene, $C_4$–$C_8$-alkynylene, phenylene, xylylene, bitolylene, $C_5$–$C_{12}$-cycloalkylene or a group —CH- $_2$—CH(OY)CH$_2$—(OCH$_2$—CH(OY)CH$_2$)$_2$—, wherein Y is hydrogen $C_1$–$C_{18}$-alkyl, allyl, benzyl, $C_2$–$C_{12}$-alkanoyl or benzoyl, or $R_{25}$ is a group —CONH—B—NHCO—, wherein B is a group $C_rH_{2r}$, phenylene, naphthylene, tolylene or a group of the formulae

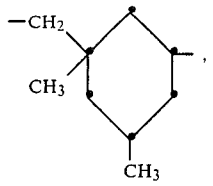

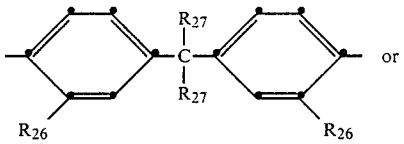

or

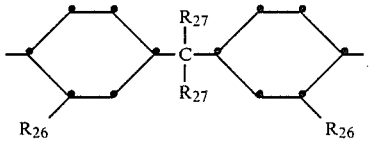

in which $R_{26}$ is hydrogen or methyl and $R_{27}$ is hydrogen, methyl or ethyl.

8. A colour-photographic recording material according to claim 1, which contains, as the component (i), a compound of the formulae VI

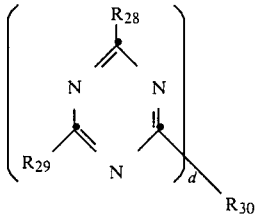

(VI)

in which d is 1 or 2 and $R_{28}$ is a group of the formula

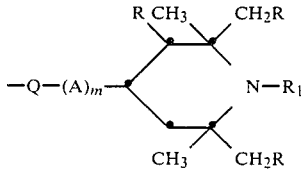

in which R and $R_1$ are as defined in claim 1, Q is —O— or —N($R_{31}$)—, A is $C_2$–$C_6$-alkylene and m is 0 or 1, $R_{29}$ is one of the groups $R_{28}$, —N$R_{31}R_{32}$, —O$R_{33}$—NHCH$_2$O$R_{33}$ or —N(CH$_2$O$R_{33}$)$_2$, $R_{30}$ is, with d=1, one of the groups $R_{28}$ or $R_{29}$ and, with d=2, is the group —Q—D—Q—, in which D is $C_2$–$C_6$-alkylene which is uninterrupted or is interrupted by —N($R_{34}$)—, $R_{31}$ is hydrogen, $C_1$–$C_{12}$-alkyl, allyl, cyclohexyl, benzyl or $C_1$–$C_4$-hydroxyalkyl or a group of the formula

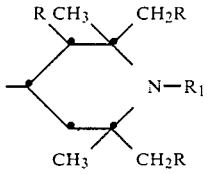

$R_{32}$ is $C_1$–$C_{12}$-alkyl, allyl, cyclohexyl, benzyl or $C_1$–$C_4$-hydroxyalkyl, $R_{33}$ is $C_1$–$C_{12}$-alkyl or phenyl and $R_{34}$ is hydrogen or the group —CH$_2$O$R_{33}$, or $R_{31}$ and $R_{32}$ together are $C_4$–$C_5$ alkylene or oxaalkylene, or $R_{31}$ and $R_{32}$ can also each be a group of the formula

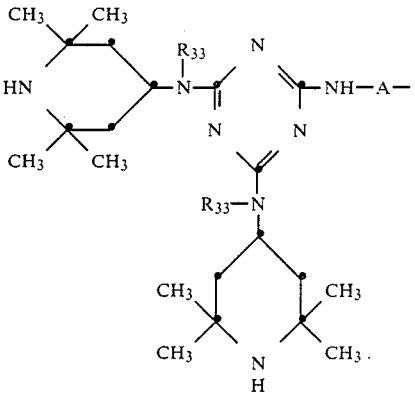

9. A colour-photographic recording material according to claim 1, which contains, as the component (i), a compound of the formula VII

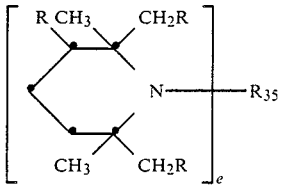

in which e is 1 or 2, R is hydrogen or methyl and $R_{35}$ is, with e=1, $C_4$–$C_{18}$-alkyl, $C_7$–$C_{12}$-aralkyl, a group —CO—$R_{36}$ or $C_1$–$C_4$-alkyl substituted by —CN, —COO$R_{37}$, —OH, —OCO$R_{38}$ or

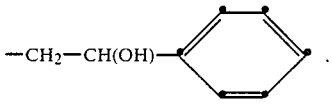

in which $R_{36}$ is $C_1$–$C_{12}$-alkyl, $C_2$–$C_4$-alkenyl or phenyl, $R_{37}$ is $C_1$–$C_{18}$-alkyl, $R_{38}$ is $C_1$–$C_{18}$-alkyl, $C_2$–$C_{10}$-alkenyl, cyclohexyl, benzyl or $C_6$–$C_{10}$-aryl, or, with e=2, $R_{35}$ is $C_4$–$C_{12}$-alkylene, but-2-en-1,4-ylene, xylylene, one of the groups —(CH$_2$)$_2$—OOC—$R_{39}$—COO—(CH$_2$)$_2$—, —CH$_2$—OOC—$R_{40}$—COO—CH$_2$— or —CH$_2$—CH(OH)—CH$_2$—O—$R_{39}$—O—CH$_2$—CH(OH)—CH$_2$—, $R_{39}$ being $C_2$–$C_{10}$-alkylene, phenylene, cyclohexylene or 2,2-diphenylenepropane and $R_{40}$ being $C_2$–$C_{10}$-alkylene, xylylene or cyclohexylene.

10. A colour-photographic recording material according to claim 1, which contains, as the component (i), a polymeric compound selected from the group comprising polyesters, polyethers, polyamides, polyamines, polyurethanes, polyureas, polyaminotriazines, poly(meth)acrylates, poly(methy)acrylamides and copolymers thereof, the recurring structural units of which contain a group of the formula I or are linked via a bivalent group of the formula (I) in which $R_1$ is a free valency, R and $R_1$ in other respects being as defined for formula I.

11. A colour-photographic recording material according to claim 1, which contains, as the component (i), a compound of the formula VIII

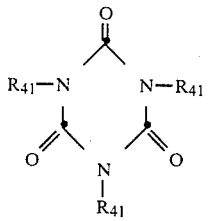

(VIII)

in which $R_{41}$ is a radical of the formula IX

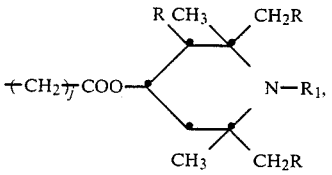

(IX)

in which j is 1 or 2 and the radicals R and $R_1$ are as defined in claim 1.

12. A colour-photographic recording material according to claim 1, which contains, as the component (ii), a phenolic antioxidant selected from the group comprising 2,6-di-tert.-butyl-4-methylphenol, 2,2'-methylene-bis-(6-tert.-butyl-4-methylphenol), 2,2'-methylene-bis-(6-tert.-butyl-4-ethylphenol), 4,4'-methylene-bis-(2,6-di-tert.-butylphenol), 2,2-bis-(2,6-di-tert.-butyl-4-hydroxyphenyl)-propane, 2,2'-methylene-bis-[4-methyl-6-(α-methylcyclohexyl)-phenol], 1,1-bis-(5-tert.-butyl-4-hydroxy-2-methylphenyl)-butane, 1,1,3-tris-(5-tert.-butyl-4-hydroxy-2-methylphenyl)-butane, ethylene glycol bis-[3,3-bis-(3-tert.-butyl-4-hydroxyphenyl)-butyrate], 4,4'-thio-bis-(6-tert.-butyl-3-methylphenol), 1,3,5-tri-(3,5-di-tert.-butyl-4-hydroxybenzyl)-2,4,6-trimethylbenzene, triethylene glycol bis-(3-methyl-5-tert.-butyl-4-hydroxy-phenyl)-propionate, 1,3,5-tris-(3,5-di-tert.-butyl-4-hydroxybenzyl)isocyanurate, diethyl 3,5-di-tert.-butyl-4-hydroxybenzylphosphonate, N,N'-di-(3,5-di-tert.-butyl-4-hydroxyphenylpropionyl)-hexamethylenediamine, 3-thia-1,5-pentanediol bis-[3-(3,5-di-tert.-butyl-4-hydroxyphenyl)-propionate], 1,6-hexanediol bis-[3-(2,5-di-tert.-butyl-4-hydroxyphenyl)-propionate], pentaerythritol tetrakis-[3-(3,5-di-tert.-butyl-4-hydroxyphenyl)-propionate], pentaerythritol tetrakis-(3,5-di-tert.-butyl-4-hydroxybenzoate), octadecyl-3-(3,5-di-tert.-butyl-4-hydroxyphenyl)-propionate, 2-(3,5-di-tert.-butyl-4-hydroxyanilino)-4,6-di-(octylthio)-triazine, 2,4-di-tert.-butylphenyl 3,5-di-tert.-4-hydroxybenzoate), the phenol of the formula XI,

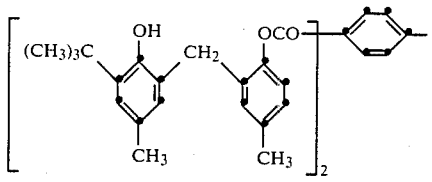

(XI)

or the phenol of the formula X

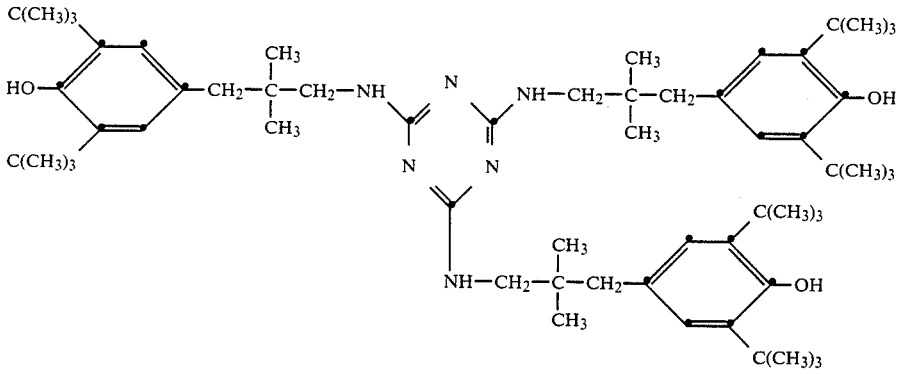

(X)

13. A colour-photographic recording material according to claim 1, which contains, as the component (i) a compound of the formula C

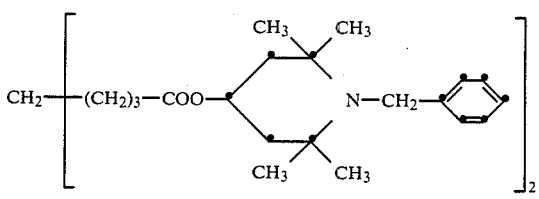

(C)

and, as the component (ii), a compound of the formula a

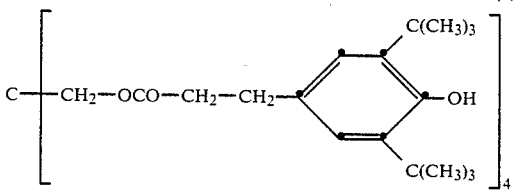

(a)

14. A colour-photographic recording material according to claim 1, which contains, as the component (i), a compound of the formula A (A)

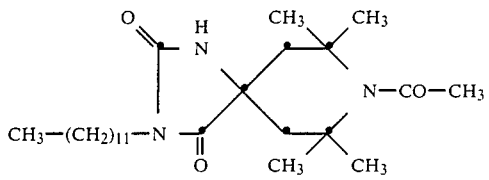

and, as the component (ii), a compound of the formula b (b)

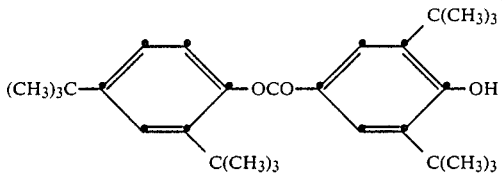

(c)

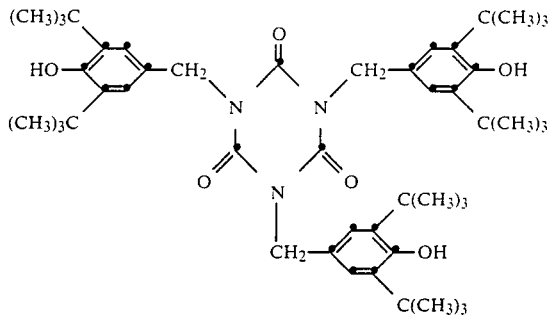

16. A colour-photographic recording material according to claim 1, which contains, as the component (i), a compound of the formula E (E)

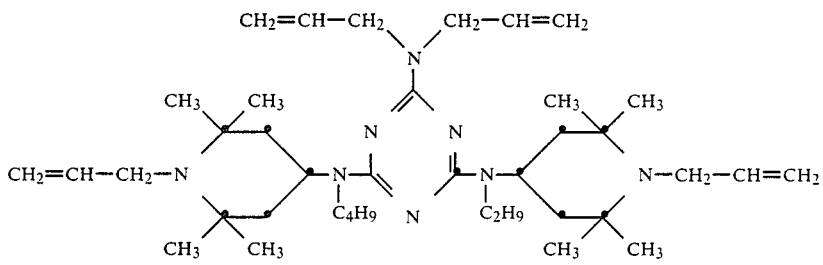

and, as the component (ii), a compound of the formula d (d)

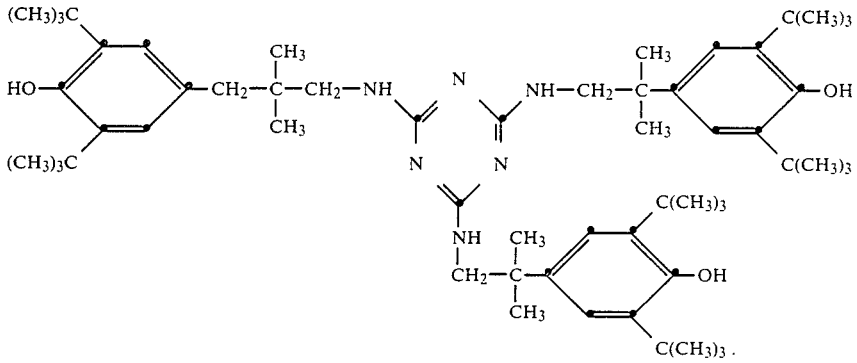

15. A colour-photographic recording material according to claim 1, which contains, as the component (i), a compound of the formula C (C)

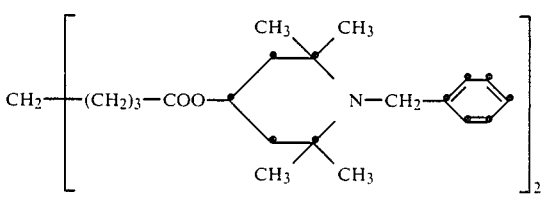

and, as the component (ii), a compound of the formula c

17. A colour-photographic recording material according to claim 1, which contains, as the component (i), a compound of the formula D (D)

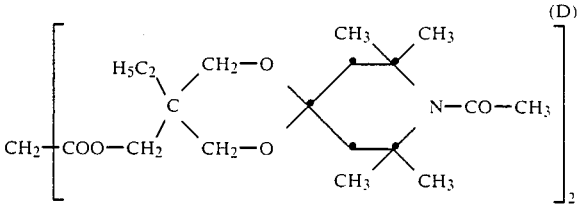

and, as the component (ii), a compound of the formula e (e)

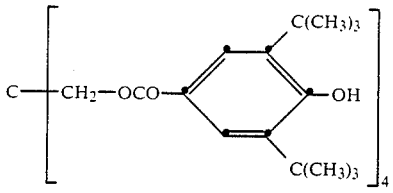

18. A colour-photographic recording material according to claim 1, which contains the stabiliser mixture (i)+(ii) in combination with cyan, magenta and yellow couplers.

19. A colour-photographic recording material according to claim 1, which contains the stabiliser mixture (i)+(ii) in combination with ultraviolet absorbers.

20. A colour-photographic recording material according to claim 19, wherein the ultraviolet absorbers are compounds of the benzophenone, acrylonitrile, thiazolidone, benzotriazole, oxazole, thiazole or imidazole types.

21. A colour-photographic recording material according to claim 1, which contains the stabiliser mixture (i) and (ii) in combination with cyan, magenta and yellow couplers and with ultraviolet absorbers in the same layer.

22. A colour-photographic recording material according to claim 1, which contains 1 to 2,000 mg of the stabiliser mixture (i) and (ii) per $m^2$ of the layer into which the stabiliser mixture is incorporated.

23. Process for the production of photographic colour images by imagewise exposure and colour development of the colour-photographic recording material according to claim 1.

* * * * *

US004517283B1

REEXAMINATION CERTIFICATE (1686th)

United States Patent [19]

[11] B1 4,517,283

Leppard et al.

[45] Certificate Issued Apr. 28, 1992

[54] COLOR-PHOTOGRAPHIC RECORDING MATERIAL

[75] Inventors: David G. Leppard, Marly; Jean Rody, Riehen, both of Switzerland

[73] Assignee: Ciba-Geigy AG, Basel, Switzerland

Reexamination Request:
No. 90/001,284, Jul. 13, 1987

Reexamination Certificate for:

| | |
|---|---|
| Patent No.: | 4,517,283 |
| Issued: | May 14, 1985 |
| Appl. No.: | 562,190 |
| Filed: | Dec. 15, 1983 |

[30] Foreign Application Priority Data

Dec. 16, 1982 [CH] Switzerland ..... 7314/82

[51] Int. Cl.[5] ..... G03C 1/34; G03C 7/26

[52] U.S. Cl. ..... 430/512; 430/372; 430/505; 430/523; 430/549; 430/551; 430/552; 430/554; 430/556; 430/931; 430/961

[58] Field of Search ..... 430/372, 551, 505, 549, 430/523, 512, 552, 554, 556

[56] References Cited

U.S. PATENT DOCUMENTS

| | | | |
|---|---|---|---|
| 3,859,293 | 1/1975 | Murayama et al. | 524/102 |
| 3,941,744 | 3/1976 | Murayama et al. | 524/102 |
| 4,110,334 | 8/1978 | Mayer et al. | 524/585 |
| 4,161,592 | 7/1979 | Evans et al. | 544/198 |
| 4,185,007 | 1/1989 | Rasberger et al. | 544/301 |
| 4,226,999 | 10/1980 | Macherbe et al. | 524/102 |
| 4,268,593 | 5/1981 | Leppard et al. | 430/372 |
| 4,452,884 | 6/1984 | Leppard et al. | 430/372 |
| 4,463,085 | 7/1984 | Mitsui | 430/372 |

*Primary Examiner*—Marion S. McCamish

[57] ABSTRACT

A color-photographic recording material which, in at least one light-sensitive silver halide emulsion layer, and interlayer and/or a protective layer, contains a stabilizer mixture comprising (i) a compound with at least one group of the formula

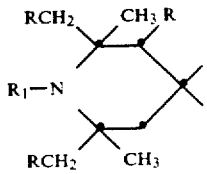

(I)

or a polymer with recurring structural units of the formula I, and (ii) a phenolic antioxidant.

Color images obtained by imagewise exposure and development of this color-photographic recording material show good stability to the action of visible and ultraviolet light.

With respect to the definitions of the substituents in formula I, reference is made to the description.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-23 are cancelled.

* * * * *